US012313080B2

(12) United States Patent
Dai et al.

(10) Patent No.: US 12,313,080 B2
(45) Date of Patent: May 27, 2025

(54) IMPELLER AND FAN ASSEMBLY

(71) Applicant: Bosch Automotive Products (Changsha) Co., Ltd., Changsha (CN)

(72) Inventors: Dongyang Dai, Changsha (CN); Chuanwei Liao, Changsha (CN); Jian Li, Changsha (CN); Linglin Wu, Changsha (CN); Liping Huang, Changsha (CN); Qinming Zeng, Changsha (CN); Yufeng Peng, Changsha (CN)

(73) Assignee: Bosch Automotive Products (Changsha) Co., Ltd., Changsha (CN)

( * ) Notice: Subject to any disclaimer, the term of this patent is extended or adjusted under 35 U.S.C. 154(b) by 0 days.

(21) Appl. No.: 18/812,183

(22) Filed: Aug. 22, 2024

(65) Prior Publication Data

US 2025/0084866 A1 Mar. 13, 2025

(30) Foreign Application Priority Data

Sep. 12, 2023 (CN) ..... 202322472982.1
Apr. 2, 2024 (CN) ..... 202410397680.9

(51) Int. Cl.
*F04D 29/32* (2006.01)
*F04D 25/08* (2006.01)

(52) U.S. Cl.
CPC ..... *F04D 29/329* (2013.01); *F04D 25/08* (2013.01)

(58) Field of Classification Search
CPC ..... F04D 29/329; F04D 25/08
See application file for complete search history.

(56) References Cited

U.S. PATENT DOCUMENTS 11,542,955 B2 * 1/2023 Haaf ..... F04D 17/06
2021/0218315 A1 * 7/2021 Azzouz ..... H02K 5/207

* cited by examiner

*Primary Examiner* — Sabbir Hasan
(74) *Attorney, Agent, or Firm* — Michael Best & Friedrich LLP

(57) ABSTRACT

An impeller includes a hub having an axial direction as a rotation axis and extending from a first end to a second end, and including an end surface and a first wall. The end surface is positioned at the first end of the hub, one end of the first wall extends around an entire periphery of the end surface and radially outwardly extends at an angle toward the second end in the axial direction. A length of extension of the first wall is greater than 50% of a length of extension of the hub. The impeller further includes a plurality of blades, the proximal ends of which extend from the periphery of the hub in a radial direction. A predetermined range of angle is formed between the first wall and the axial direction, and the predetermined range of angle is between 3 degrees and 45 degrees.

14 Claims, 5 Drawing Sheets

IMPELLER AND FAN ASSEMBLY

BACKGROUND

The present application relates to the field of ventilation devices. More specifically, the present application relates to an impeller intended to provide improved foreign matter removal capabilities. The present application also relates to a fan assembly comprising the impeller as described above.

Vehicles typically include one or more ventilation devices, such as fans. A fan typically includes an impeller and a motor, with the impeller being driven by the motor. Under some operating conditions, foreign matter (such as grit or water) may enter the gap between the impeller and the motor and may accumulate at the hub of the impeller. Such undesirable accumulation of foreign matter may cause uneven mass distribution or increase the mass of the impeller, causing vibration, wear or difficulty in starting. In a known fan, foreign matter may accumulate between the hub of the impeller and the rotor of the motor. When the fan is in operation, foreign matter tends to accumulate on the radial exterior of the hub under the action of centrifugal force.

SUMMARY

An object of the present application is to provide an impeller that is capable of effectively expelling foreign matter, such as grit or water. Another object of the present application is to provide a fan assembly, which comprises the impeller described above.

The aims of the present application are achieved through the following technical solutions:

An impeller, consisting of:

a hub having an axial direction as a rotation axis and extending from a first end to a second end, and including an end surface and a first wall, wherein the end surface is positioned at the first end of the hub, one end of the first wall extends around the entire periphery of the end surface and radially outwardly extends at an angle toward the second end in the axial direction, wherein the length of extension of the first wall in the axial direction is greater than 50% of the length of extension of the hub from the first end to the second end in the axial direction; and a plurality of blades, the proximal ends of which extend from the periphery of the hub in a radial direction;

wherein, a predetermined range of angle is formed between the first wall and the axial direction, and the predetermined range of angle is set to be between 3 degrees and 45 degrees.

In the impeller described above, optionally, the cross-sectional shape of the first wall in the axial direction comprises one or more line segments, and the predetermined range of angle (A1) is between 3 degrees and 5 degrees, 5 degrees and 10 degrees, 10 degrees and 15 degrees, 15 degrees and 20 degrees, 20 degrees and 25 degrees, 25 degrees and 30 degrees, 30 degrees and 35 degrees, 35 degrees and 40 degrees, or 40 degrees and 45 degrees; or the cross-sectional shape of the first wall in the axial direction is configured as a curve.

In the impeller described above, optionally, the hub comprises a second wall, wherein the second wall is arranged around the entire first wall; the proximal ends of the blades extend from the outer side of the second wall; the first wall is attached to the inner side of the second wall, forming a groove between the first wall and the second wall.

In the impeller described above, optionally, the second wall is arranged substantially parallel to the axial direction and extends toward the plane where the end surface is located; and/or comprises a plurality of second ribs extending between the first wall and the second wall and arranged within the groove.

In the impeller described above, optionally, it comprises a plurality of first ribs being arranged along a circumferential direction in a substantially uniform or non-uniform manner, wherein the first ribs extend radially inward from the first wall and at least partially extend to the end surface.

In the impeller described above, the end surface includes a plurality of through-holes being disposed at one or more of the following positions: extended through the first wall near the base of the first rib, or extended through the end surface near the base of the first rib.

In the impeller described above, optionally, the arrangement of the through-holes is as follows: positioned near one side of the first rib facing the direction of rotation of the impeller during rotation, such that a portion of grit or water entering the interior of the hub accumulates at the base of the first rib on the side facing the direction of rotation under the action of centrifugal force when the impeller rotates, and exits the impeller through the through-holes; wherein the interior space of the hub includes a motor installation space and surrounding space, of which the motor installation space is used to accommodate a motor rotor, and the first ribs and the through-holes are located in the surrounding space.

In the impeller described above, optionally, the hub comprises an annular groove being arranged near the first wall and surrounding the entire end surface; the annular groove and the first wall are located on opposite sides of the end surface, wherein the annular groove is configured for mounting a balancing ball.

In the impeller described above, optionally, it includes a ring, to which a distal end of the blade is attached, and which extends in the circumferential direction.

In the impeller described above, optionally, the hub includes a lid, which covers the groove, wherein the lid is attached to the first wall and the second wall by one of the following methods: adhesive bonding, bolt connection, or welding.

A fan assembly, comprising:

the impeller described above;

a motor consisting of a rotor and a stator, wherein the end surface of the impeller is attached to the rotor; and a frame, to which the stator of the motor is attached, and which is arranged around the distal end of the blade.

In the fan assembly described above, optionally, the end surface of the impeller further includes a plurality of mounting holes, to which the motor rotor is attached.

BRIEF DESCRIPTION OF THE DRAWINGS

The present application will be described in further detail below in conjunction with the accompanying drawings and preferred examples. It will be appreciated by those skilled in the art that these accompanying drawings are drawn for purposes of interpreting preferred examples only, and therefore should not be construed as limiting the scope of the present application. In addition, unless otherwise specified, the accompanying drawings are intended purely to conceptually represent the composition or construction of the described objects and may include exaggerated representations. The accompanying drawings are also not necessarily to scale.

DETAILED DESCRIPTION

Preferred examples of the present application will be described in detail below with reference to the accompanying drawings. It will be appreciated by those skilled in the art that these descriptions are purely descriptive, exemplary, and should not be construed as limiting the scope of protection of the present application.

First, it should be noted that the terms top, bottom, upward, downward, and other orientation terms referred to herein are defined relative to the orientations in each of the accompanying drawings. These orientations are relative concepts and therefore will vary based on their respective positions and states. Therefore, these or other orientation terms should not be construed as limiting.

In addition, it should be noted that for any single technical feature described or implied in the examples herein or shown or implied in the accompanying drawings, these technical features (or equivalent thereof) can be combined to obtain other examples not explicitly mentioned herein.

It should be noted that in different drawings, the same reference numbers represent the same or substantially similar components.

FIGS. 1-5 illustrate different aspects of one example of an impeller of the present application. In one example, the impeller 10 may consist of a hub 100, a blade 200, a ring 300, and so on. However, it is readily understood that the ring 300 is not required. For example, the impeller may include only the hub 100 and the blade 200. The hub 100 may be configured to rotate in the axial direction A-A as an axis, the blade 200 may be configured to extend in the radial direction R-R, and the ring 300 may be configured to extend in the circumferential direction C-C.

When used herein, axial direction A-A refers to the direction in which the rotation axis of the impeller of the fan assembly lies. The radial direction R-R refers to the direction in which the radius of the circular profile of the impeller 10 is directed, or the direction indicated by an incidence line starting from a point on the axial direction A-A and extending in a plane perpendicular to the axial direction A-A. The circumferential direction C-C refers to the direction in which the circumference of the circular profile of the impeller 10 is located. Further, herein, radially outward or radially inward refers to a direction away from or toward the rotation axis of the impeller 10 substantially in the radial direction R-R.

Figure 1:
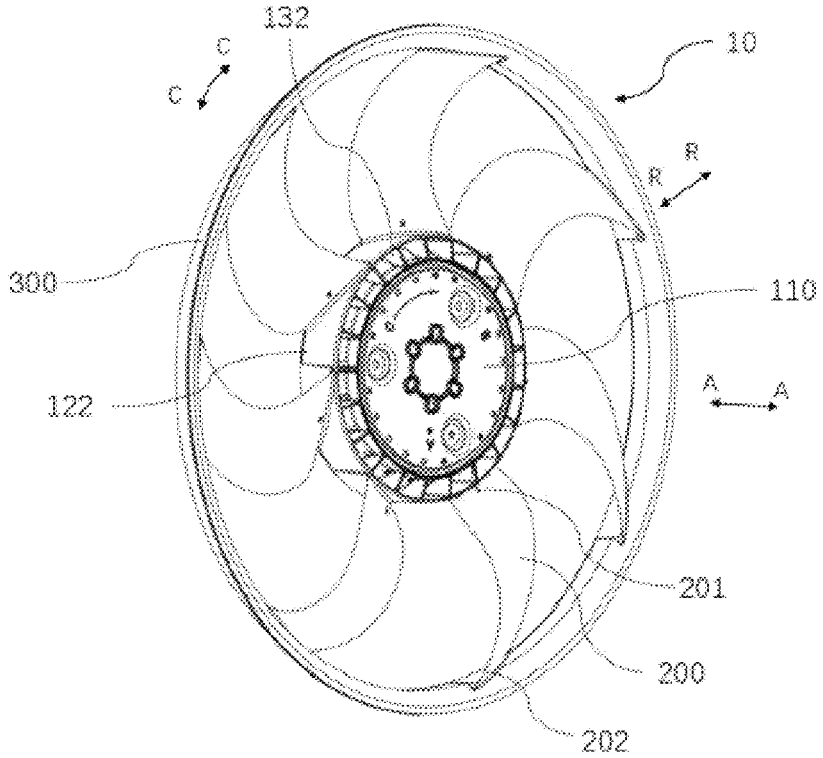
FIG. 1 is an isometric view of one example of an impeller of the present application.
Figure 2:
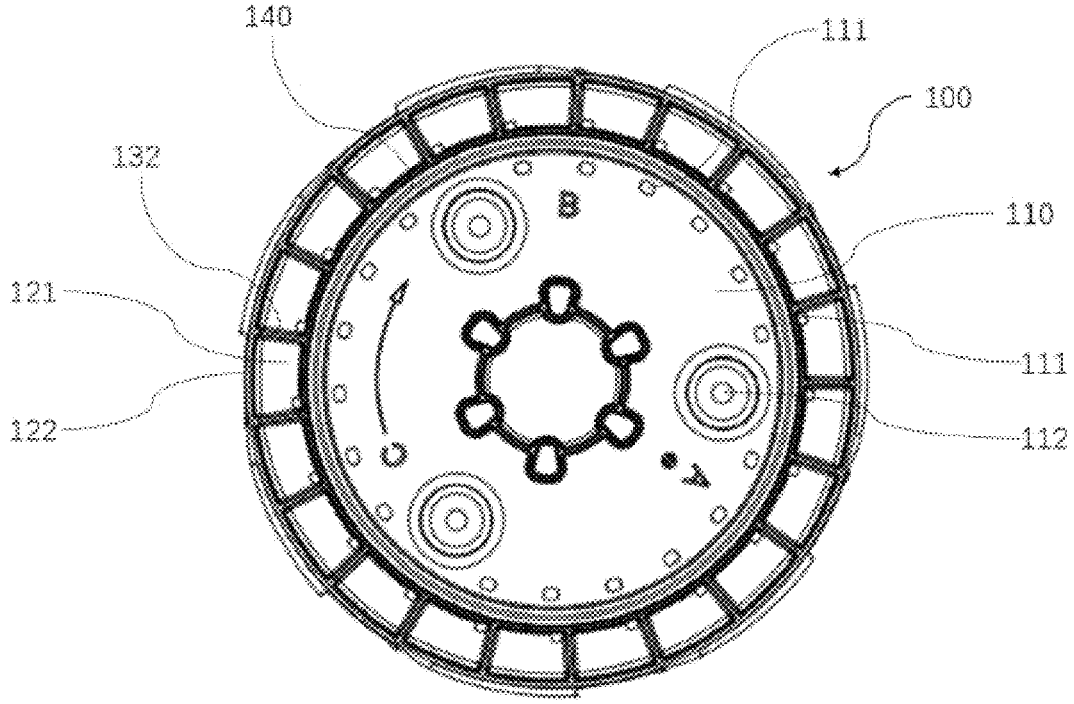
FIG. 2 is a partially enlarged front view of the hub portion of FIG. 1.
Figure 3:
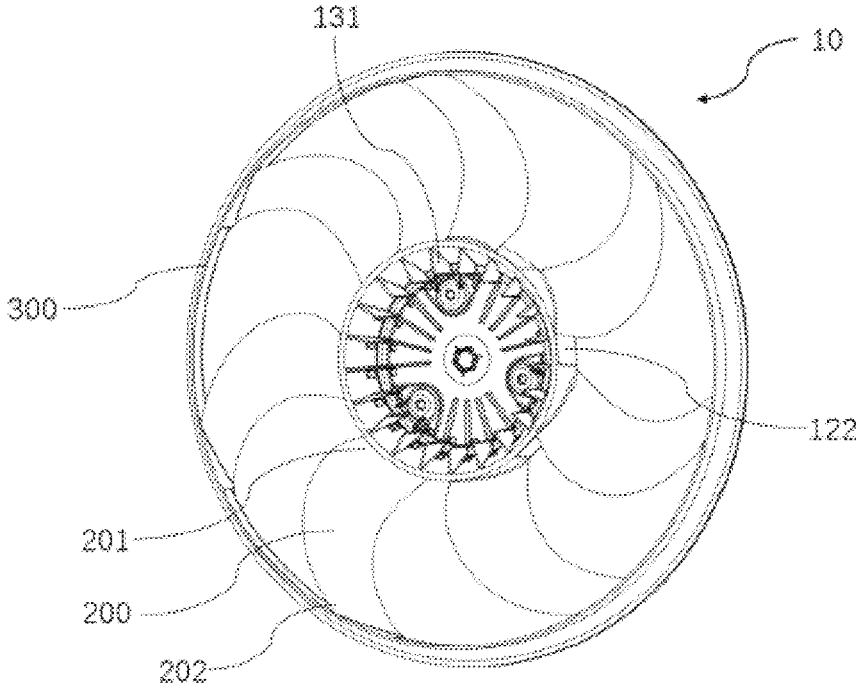
FIG. 3 is another isometric view of the example shown in FIG. 1.
Figure 4:
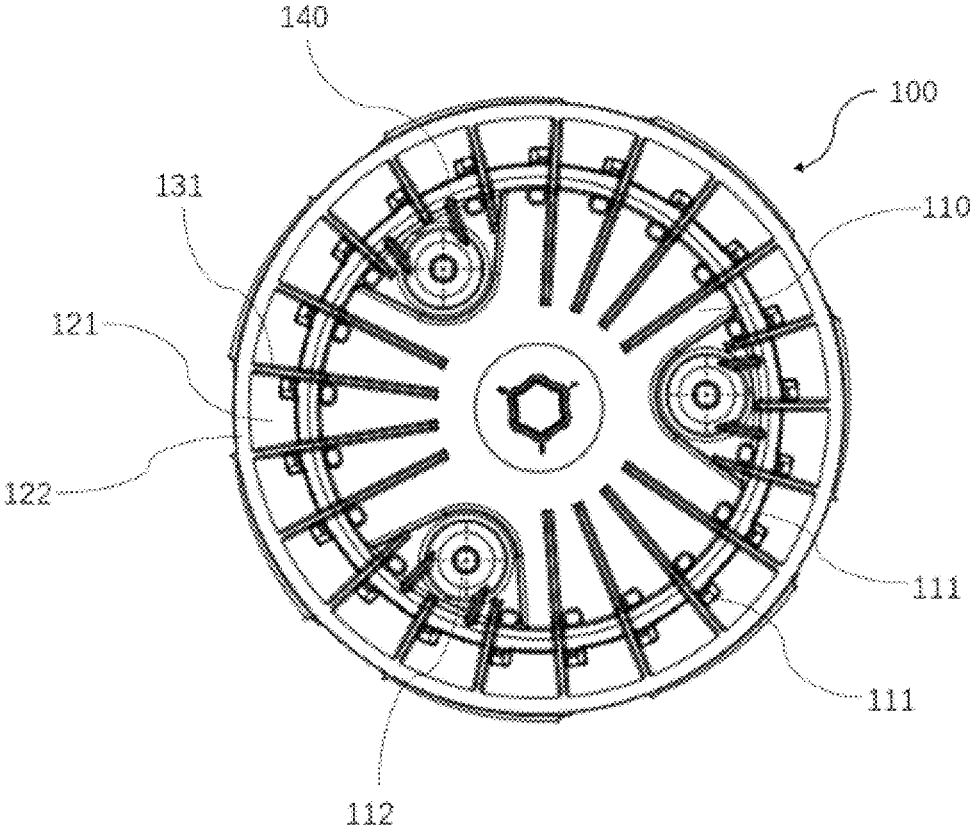
FIG. 4 is a partially enlarged front view of the hub portion of FIG. 3.
Figure 5:
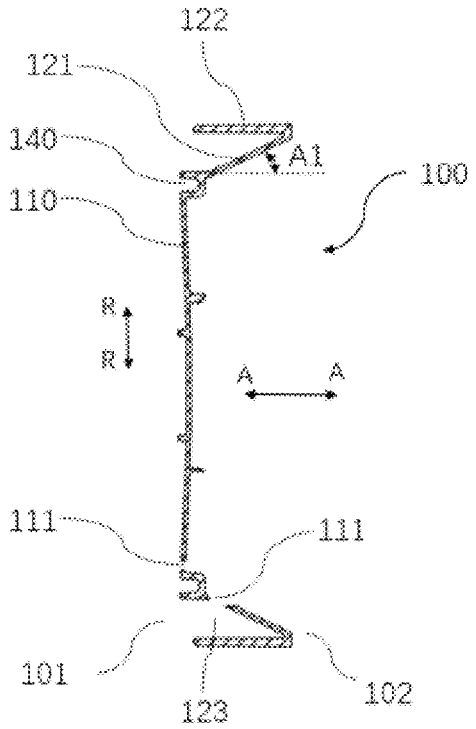
FIG. 5 is a cross-sectional view of the hub of the example shown in FIG. 1.

The hub 100 may include an end surface 110, a first wall 121, a second wall 122, a plurality of first ribs 131, an annular groove 140, and so on. The hub 100 may extend from the first end 101 to the second end 102 in the axial direction A-A, as shown in FIG. 5. As illustrated, the end surface 110 may have a substantially circular shape and extend along the radial direction R-R. The end surface 110 may include a plurality of through-holes 111 and a plurality of mounting holes 112. The through-holes 111 may be substantially uniformly arranged along the perimeter of the end surface 110 and extend through the end surface 111. The mounting holes 112 may also extend through the end surface 110 and may be configured for attaching the motor rotor 500 of the motor 20, as described in detail below. The mounting holes 112 may be evenly arranged on the end surface 110 and may be used to install the first fastener 700, as described in detail below.

One end of the first wall 121 may extend from the periphery of the end surface 110 all the way to the end. As shown in FIG. 5, the first wall 121 may extend toward one side of the end surface 110 and extend at an angle relative to the axial direction A-A. In one example, the first wall 121 may be viewed as extending radially outward. As shown in FIG. 5, a predetermined range of angle A1 may be formed between the first wall 121 and the axial direction A-A. The predetermined range of angle A1 may be between 3 degrees and 45 degrees. In one example, the predetermined range of angle A1 is larger than the draft angle of conventional wall structures. For example, conventional wall structures typically have a draft angle of 1 to 2 degrees. In one example, the predetermined range of angle (A1) may be between 3 degrees and 5 degrees, 5 degrees and 10 degrees, 10 degrees and 15 degrees, 15 degrees and 20 degrees, 20 degrees and 25 degrees, 25 degrees and 30 degrees, 30 degrees and 35 degrees, 35 degrees and 40 degrees, or 40 degrees and 45 degrees. In the illustrated example, the first wall 121 is configured to have a substantially linear shape, or alternatively, the cross-sectional shape of the first wall 121 in the axial direction A-A is configured in a linear shape and is formed by a single line segment. However, the first wall 121 may actually be configured in other shapes, for example, the cross-sectional shape in the axial direction A-A may be a curve, such as a hyperbola, a brachistochrone curve, a parabola, or the like. In one example, the first wall 121 may be stepped. In one example, the first wall 121 may be formed from a plurality of line segments.

The first wall 121 has a certain length of extension. As shown in FIG. 5, in one example of the present application, the first wall 121 may extend substantially from the first end 101 to the second end 102 of the hub 100. In one example, the length of extension of the first wall 121 in the axial direction A-A may be greater than 50% of the length of extension of the first end 101 and the second end 102 of the hub 100 in the axial direction A-A. The length of extension of the first wall 121 in the axial direction A-A may be expressed as: a virtual incidence line drawn along the axial direction A-A with one end of the first wall 121 as the starting point, and a vertical line drawn toward the virtual incidence line from the other end of the first wall 121 as the starting point. The direction of the vertical line is set perpendicular to the axial direction A-A. The vertical line intersects with the virtual incidence line. A portion of the virtual incidence line between the intersection point and one end of the first wall 121 is also referred to herein as a projection of the first wall 121 in the axial direction A-A. A portion of this virtual incidence line is the length of extension of the first wall 121 in the axial direction A-A.

During operation, foreign matter (such as grit or water) may enter between the hub 100 and the motor rotor 500 as the impeller 10 rotates, the foreign matter may be moved along the first wall 121 under the action of centrifugal force and exit the impeller 10 at the end of the first wall 121. In this way, the impeller 10 is capable of automatically expelling the foreign matter, thereby avoiding undesirable accumulation of foreign matter, effectively improving the operational safety of the impeller 10 and the service life of the components.

The second wall 122 may be attached to an end of the first wall 121. As shown in FIG. 5, the second wall 122 may extend along the axial direction A-A, or be arranged substantially parallel to the axial direction A-A. The second wall 122 may be arranged around an end of the entire first wall 121. Furthermore, the direction of extension of the second wall 122 may be substantially opposite to the first wall 121 such that the projections of the first wall 121 and the second wall 122 in the axial direction A-A at least partially overlap. In one example, a draft angle may be formed between both sides of the second wall 122 and the axial direction A-A, and the angle of the draft angle may be about 1 degree. A groove 123 may be formed between the first wall 121 and the second wall 122. In one example, the groove 123 may extend in a circumferential direction C-C. In one example, the opening of the groove 123 may be towards the first end 101.

The first ribs 131 and the second ribs 132 may be arranged along the circumferential direction C-C, for example, substantially uniformly or non-uniformly. In the illustrated example, the first rib 131 may extend from the first wall 121 and at least partially onto the end surface 110, or at least partially onto a side of the end surface 110. The second rib 132 may extend between the first wall 121 and the second wall 122 and may be disposed within the groove 123. The first rib 131 may be a protruding portion along the axial direction A-A, and may serve as a structural reinforcement.

The annular groove 140 may be disposed near an end of the first wall 121 and extend around the periphery of the end surface 110. In one example, the annular groove 140 may be used to mount a balancing ball. The annular groove 140 and the first wall 121 may be located at both sides of the end surface 110.

A plurality of through-holes 111 may be arranged near the base of the first rib 131. For example, the through-holes 111 may extend through the end surface 110 or the first wall 121. The through-holes 111 may be arranged on one side of the first rib 131 facing the direction of rotation of the impeller 10. The function of the through-hole 111 is to expel a portion of the foreign matter. For example, when the impeller 10 rotates, some foreign matter will be drawn towards the base of the first rib 131 on the side facing the direction of rotation of the impeller 10 under the action of centrifugal force, such as accumulating towards the locations of the two through-holes 111 as shown in FIG. 5. At this point, the foreign matter may be expelled through the through-holes 111. As shown in FIG. 5, the through-holes 111 may be arranged near the annular groove 140.

In addition, the space inside the hub 100 may be divided into a motor installation space and a surrounding space. For example, the space enclosed by the end surface 100 and the second wall 122 may accommodate a motor rotor 500, a first rib 131, and a second rib 132, which are not shown. When the motor rotor 500 is installed, the outer contour of which is positioned adjacent to the first rib 131; the space occupied by the motor rotor 500 may be referred to as the motor installation space, and the space inside the hub 100 outside the motor rotor 500 may be referred to as the surrounding space. In one example, the first rib 131, the second rib 132 and the plurality of through holes 111 are disposed in the surrounding space.

The blade 200 may include a proximal end 201 and a distal end 202. In the illustrated example, the proximal end 201 of the blade 200 extends from a periphery of the hub 100, such as from the second wall 122 in the radial direction R-R. In one example, the proximal end 201 of the blade 200 may extend in the radial direction R-R from the first wall 121. The distal end 202 of the blade 200 is connected to the ring 300.

The ring 300 may have a substantially circular profile and may be attached to the distal end 202 of each blade 200. It should be noted that the ring 300 is not necessary but optional.

In one example, various parts of the hub 100 may be integrally manufactured. In one example, various parts of the impeller 10 may be integrally manufactured.

Figure 6:
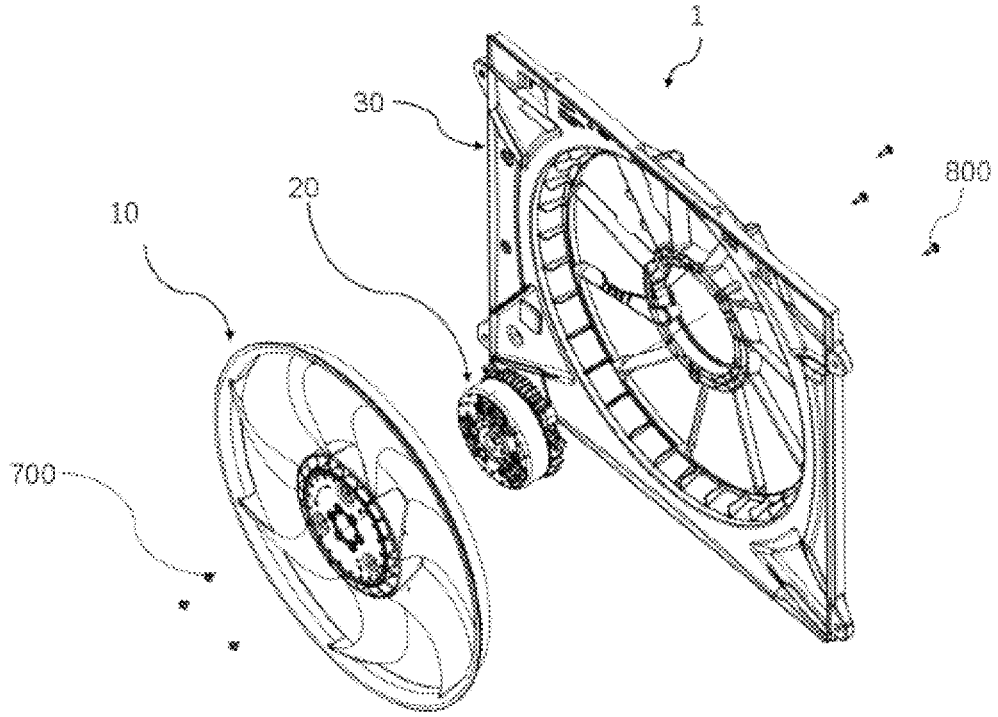
FIG. 6 is an exploded view of one example of a fan assembly of the present application.
Figure 7:
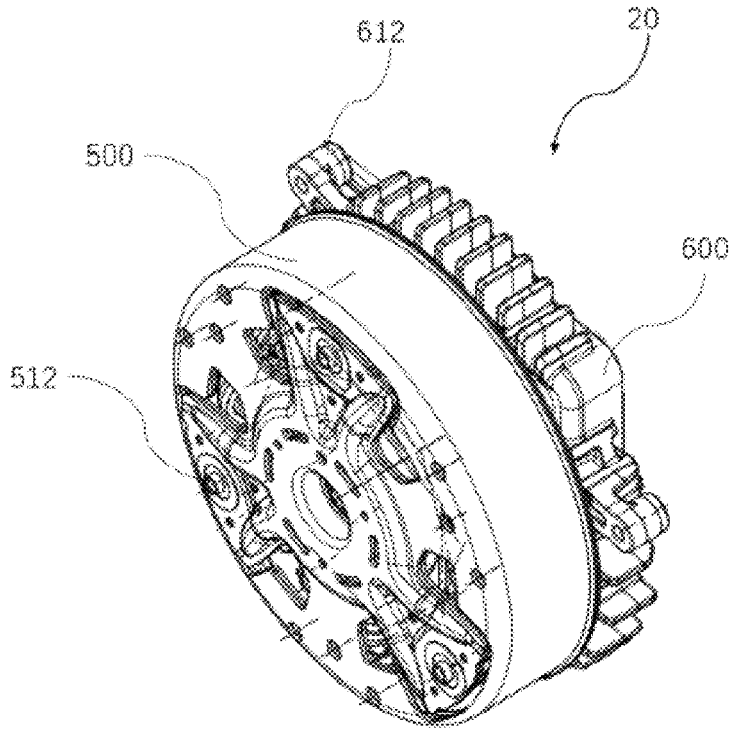
FIG. 7 is an isometric view of the motor of the example shown in FIG. 6.
Figure 8:
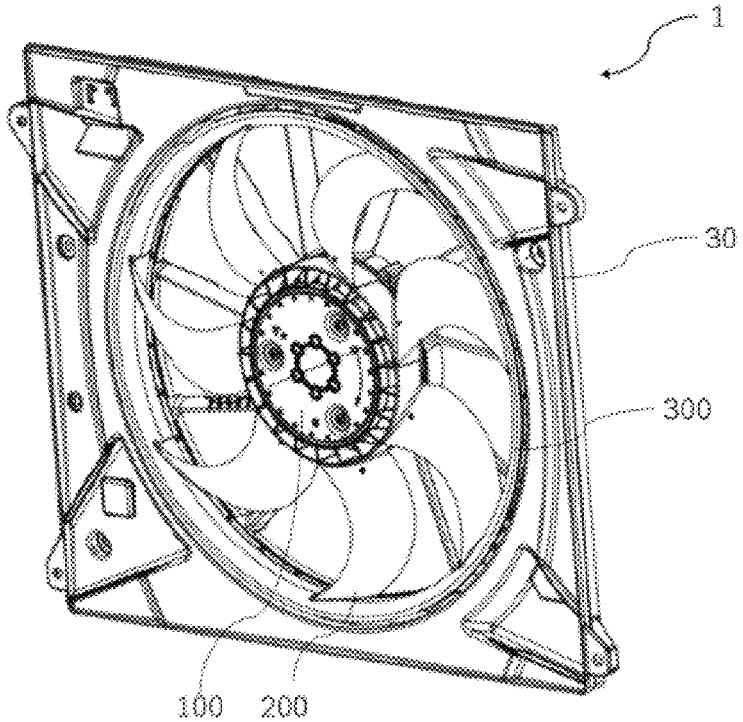
FIG. 8 is an isometric view of the example shown in FIG. 6 after assembly is complete.

FIGS. 6-8 illustrate an example of the fan assembly 1 of the present application. As shown, the impeller 10, motor 20, and frame 30 are assembled together. The motor 20 may include a rotor 500 and a stator 600. The rotor 500 includes a plurality of mounting holes 512 and may be mounted to the end surface 110 by a first fastener 700. As shown, the rotor 500 has a substantially cylindrical shape and, in fact, the rotor 500 is attached to the end surface 110 with a gap existing between the side thereof and the first rib 131. This gap is arranged for installation and heat dissipation needs, and foreign matter may enter the space between the rotor 500 and the hub 100 there through. Similarly, the stator 600 may also include a plurality of mounting holes 612 and may be mounted to the frame 30 by a second fastener 800. Accordingly, upon installation in place, the rotor 500 and the impeller 10 may pivot relative to the frame 30, such as about the axial direction A-A.

Thus, after assembly, the impeller 10 is pivotally attached to the frame 30, which surrounds the distal end 202 of the blade 200. In the illustrated example, the frame 30 surrounds the ring 300 of the impeller 10.

Figure 9:
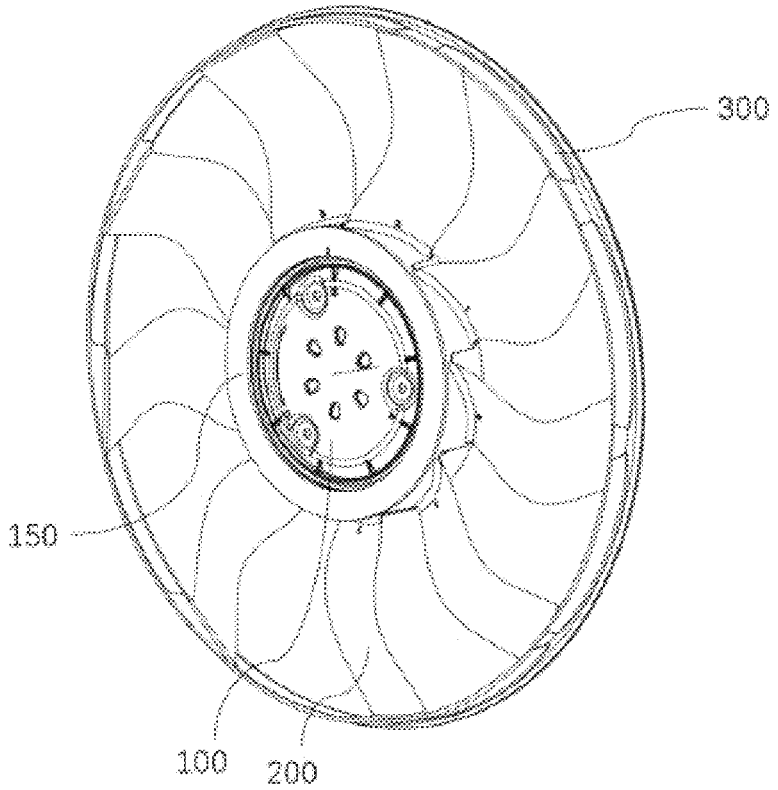
FIG. 9 is an isometric view of another example of an impeller of the present application.
Figure 10:
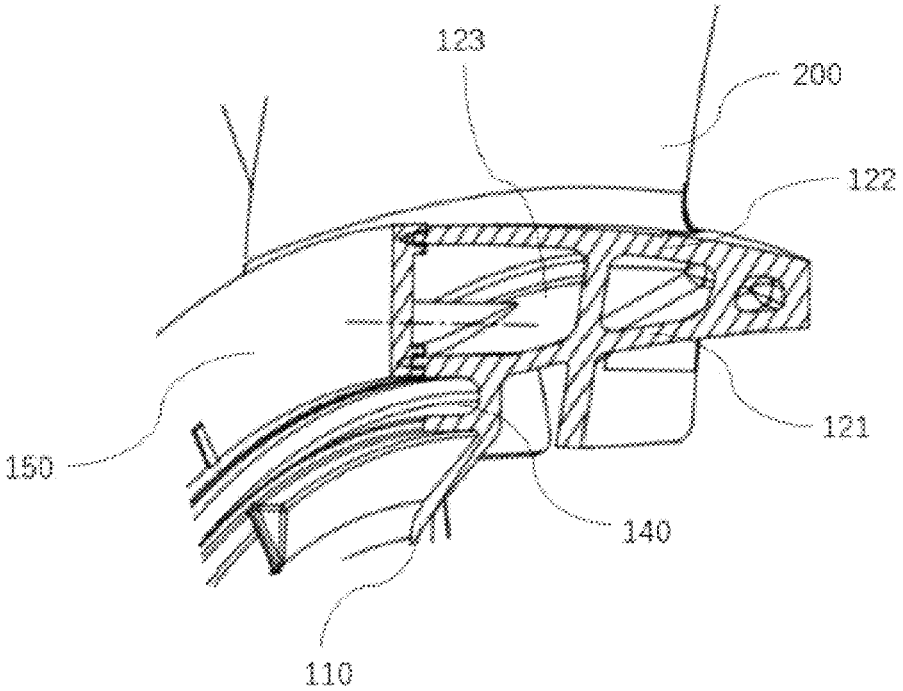
FIG. 10 is a partial cross-sectional view of the example shown in FIG. 9.

FIGS. 9 and 10 illustrate another example of the present application. In this example, the impeller 10 may include a lid 150. The lid 150 may be attached to the first wall 121 and the second pen 122, for example, to one end of the first wall 121 and the end of the second wall 122, and may cover the groove 123. In one example, the lid 150 may be planar in shape. In one example, the lid 150 may include a step, a curve, or other suitable shapes. The lid 150 may be attached to the first wall 121 and/or the second wall 122 by one of the following methods: adhesive bonding, bolt connection, welding, or the like. In one example, the lid 150 is secured in place by laser or ultrasonic welding. In one example, the portion of the lid 150 that contacts the first wall 121 and the second wall 122 may include a stepped mating structure or a structure comprising protrusions and recesses, allowing the lid 150 to easily mate and be positioned in place with the first wall 121 and the second wall 122 before welding, adhesive bonding, or bolt connection. Furthermore, one end of the first wall 121 and the end of the second wall 122 may be substantially flush in the axial direction A-A such that the lid 150 is positioned perpendicular to the axial direction A-A. As shown in FIG. 9, the lid 150 may have a substantially annular profile.

In one example, the lid 150 prevents foreign matter from entering the space between the first wall 121 and the second wall 122, or may prevent foreign matter from entering the groove 123. For example, the lid 150 may completely seal the space between one end of the first wall 121 and the end of the second wall 122, or may completely seal the groove 123 to prevent grit or dust from entering, thereby effectively improving the dustproof performance of the impeller 10.

The impeller and fan assembly of the present application may be used in a vehicle, for example, as an intake fan or an exhaust fan. In one example, the impeller and fan assembly of the present application may be used in a vehicle operating in a desert area or wet area.

The impeller and fan assembly of the present application have the advantages of simplicity, reliability, ease of implementation, and ease of use, while also providing improved capability for removal of foreign matter. By employing the impeller and fan assembly of the present application, the lifespan of the fan assembly is extended, and its reliability is improved.

This specification discloses the present application with reference to the accompanying drawings and also enables those skilled in the art to implement the present application, including the manufacture and use of any device or system, the selection of suitable materials, and the use of any combination of methods. The scope of the present application is defined by the technical solutions for which protection is sought and includes other examples that may be conceivable to those skilled in the art. As long as such other examples comprise structural elements that do not differ from the literal description of the technical solutions for which protection is sought or comprise equivalent structural elements that do not substantially differ from the literal description of the technical solutions for which protection is sought, such other examples should be considered within the scope of protection defined by the technical solutions for which protection is sought under the present application.

What is claimed is:

1. An impeller comprising:

a hub (100) having an axial direction (A-A) as a rotation axis and extending from a first end (101) to a second end (102), and including an end surface (110) extending perpendicular to the axial direction (A-A) and a first wall (121), wherein the end surface (110) is positioned at the first end (101) of the hub (100), one end of the first wall (121) extends around an entire periphery of the end surface (110) and radially outwardly extends at an angle toward the second end (102) in the axial direction (A-A), wherein a length of extension of the first wall (121) in the axial direction (A-A) is greater than 50% of a length of extension of the hub (100) from the first end (101) to the second end (102) in the axial direction (A-A); and a plurality of blades (200), proximal ends (201) of which extend from a periphery of the hub (100) in a radial direction (R-R);

wherein, a predetermined range of angle (A1) is formed between the first wall (121) and the axial direction (A-A), and the predetermined range of angle (A1) is between 3 degrees and 45 degrees.

2. The impeller according to claim 1, wherein a cross-sectional shape of the first wall (121) in the axial direction (A-A) comprises one or more line segments, and the predetermined range of angle (A1) is between 3 degrees and 5 degrees, 5 degrees and 10 degrees, 10 degrees and 15 degrees, 15 degrees and 20 degrees, 20 degrees and 25 degrees, 25 degrees and 30 degrees, 30 degrees and 35 degrees, 35 degrees and 40 degrees, or 40 degrees and 45 degrees; or the cross-sectional shape of the first wall (121) in the axial direction (A-A) is configured as a curve.

3. The impeller according to claim 1, wherein the hub (100) comprises a second wall (122), wherein the second wall (122) is arranged around an entirety of the first wall (121); the proximal ends (201) of the plurality of blades (200) extend from an outer side of the second wall (122); the first wall (121) is attached to an inner side of the second wall (122), forming a groove (123) between the first wall (121) and the second wall (122).

4. The impeller according to claim 3, wherein the second wall (122) is arranged substantially parallel to the axial direction (A-A) and extends toward a plane where the end surface (110) is located; and/or comprises a plurality of second ribs (132) extending between the first wall (121) and the second wall (122) and arranged within the groove (123).

5. The impeller according to claim 4, wherein the hub (100) includes a lid (150), which covers the groove (123), wherein the lid (150) is attached to the first wall (121) and the second wall (122) by one of adhesive bonding, bolt connection, or welding.

6. The impeller according to claim 3, wherein the hub (100) includes a lid (150), which covers the groove (123), wherein the lid (150) is attached to the first wall (121) and the second wall (122) by one of adhesive bonding, bolt connection, or welding.

7. The impeller according to claim 1, further comprising a plurality of first ribs (131) arranged along a circumferential direction (C-C) in a substantially uniform or non-uniform manner, wherein the plurality of first ribs (131) extend radially inward from the first wall (121) and at least partially extend to the end surface (110).

8. The impeller according to claim 7, wherein the end surface (110) includes a plurality of through-holes (111) disposed at one or more of the following positions: extended through the first wall (121) adjacent to a base of a first rib (131) of the plurality of first ribs (131), or extended through the end surface (110) adjacent to the base of the first rib (131).

9. The impeller according to claim 8, wherein the arrangement of the plurality of through-holes (111) is as follows: positioned adjacent to one side of the first rib (131) facing a direction of rotation of the impeller (10) during rotation, such that a portion of grit or water entering an interior of the hub (100) accumulates at the base of the first rib (131) on a side facing the direction of rotation under an action of centrifugal force when the impeller (10) rotates, and exits the impeller (10) through the plurality of through-holes (111); wherein an interior space of the hub (100) includes a motor installation space and surrounding space, of which the motor installation space is used to accommodate a motor rotor (500), and the plurality of first ribs (131) and the plurality of through-holes (111) are located in the surrounding space.

10. The impeller according to claim 1, wherein the hub (100) comprises an annular groove (140) arranged nearer to the first wall (121) than a second wall (122) that surrounds the first wall (121), the annular groove (140) surrounding an entirety of the end surface (110); the annular groove (140) and the first wall (121) are located on opposite sides of the end surface (110), wherein the annular groove (140) is configured for mounting a balancing ball.

11. The impeller according to claim 1, further comprising a ring (300), to which a distal end (202) of the plurality of blades (200) is attached, and which extends in a circumferential direction (C-C).

12. A fan assembly comprising:

the impeller (10) according to claim 1;

a motor (20) consisting of a rotor (500) and a stator (600), wherein the end surface (110) of the impeller (10) is attached to the rotor (500); and a frame (30), to which the stator (600) of the motor (20) is attached, and which is arranged around a distal end (202) of the plurality of blades (200).

13. The fan assembly according to claim 12, wherein the end surface (110) of the impeller (10) further includes a plurality of mounting holes (112), to which the rotor (500) is attached.

14. The impeller according to claim 1, wherein the hub (100) comprises a second wall (122), wherein the second wall (122) is arranged around an entirety of the first wall (121); the proximal ends (201) of the plurality of blades (200) extend from an outer side of the second wall (122).

* * * * *